United States Patent [19]

Dorsch

[11] Patent Number: 4,961,405

[45] Date of Patent: Oct. 9, 1990

[54] AIR SHROUD FOR CYLINDER AND CYLINDER HEAD ASSEMBLIES

[75] Inventor: Mark E. Dorsch, Chesapeake, Va.

[73] Assignee: Bauer Processed Air, Inc., Norfolk, Va.

[21] Appl. No.: 405,981

[22] Filed: Sep. 12, 1989

[51] Int. Cl.[5] ..... F02F 1/34

[52] U.S. Cl. ..... 123/41.61; 123/41.7; 417/273; 417/372

[58] Field of Search ..... 123/41.56, 41.6, 41.61, 123/41.69, 41.7; 417/372, 273, 271

[56] References Cited

U.S. PATENT DOCUMENTS

| | | | |
|---|---|---|---|
| 1,907,454 | 5/1933 | Squires | 123/41.56 |
| 1,944,878 | 1/1934 | Diehl | 123/41.7 |
| 2,057,010 | 10/1936 | Chilton | 123/41.61 |
| 2,061,171 | 11/1936 | Ryder | 123/41.61 |
| 2,150,912 | 3/1939 | Clapp | 417/243 |
| 3,017,943 | 1/1962 | Forstner et al. | 123/41.6 |
| 4,204,486 | 5/1980 | Nakagawa et al. | 123/41.6 |

*Primary Examiner*—Noah P. Kamen

[57] ABSTRACT

A air shroud for cylinder and cylinder head assemblies of air-cooled compressors and engines of the type having a cooling air fan for producing an axial flow of cooling air and an array of cylinder and cylinder head assemblies arranged in the path of the axial flow and extending radially relative to the axis of said flow. In particular, the shroud has a flow channel portion of a polygonal segment shape which wraps around the periphery of the array of cylinder and cylinder head assemblies and forms an air channel from the cooling air fan to the cylinder and cylinder head assemblies and which is fastened atop each of the cylinder and cylinder head assemblies. In order to increase the quantity and rate of flow of cooling air over the cylinder and cylinder head assemblies while increasing the surface area of the assemblies washed by the cooling air, fins are provided depending from the flow channel portion of the shroud at a point between 50 to 90% of the distance across the cylinder and cylinder head assemblies viewed in the airflow direction, each of the fins blocking an open area between adjacent cylinder and cylinder head assemblies in a manner creating an airflow orifice gap about its perimeter between the fin and the adjcent cylinder and cylinder head assemblies.

9 Claims, 3 Drawing Sheets

FIG. 2
(PRIOR ART)
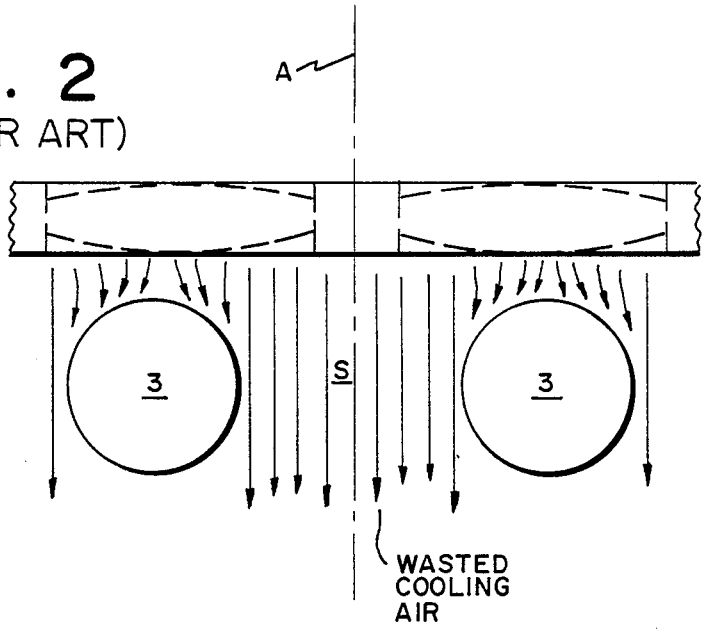
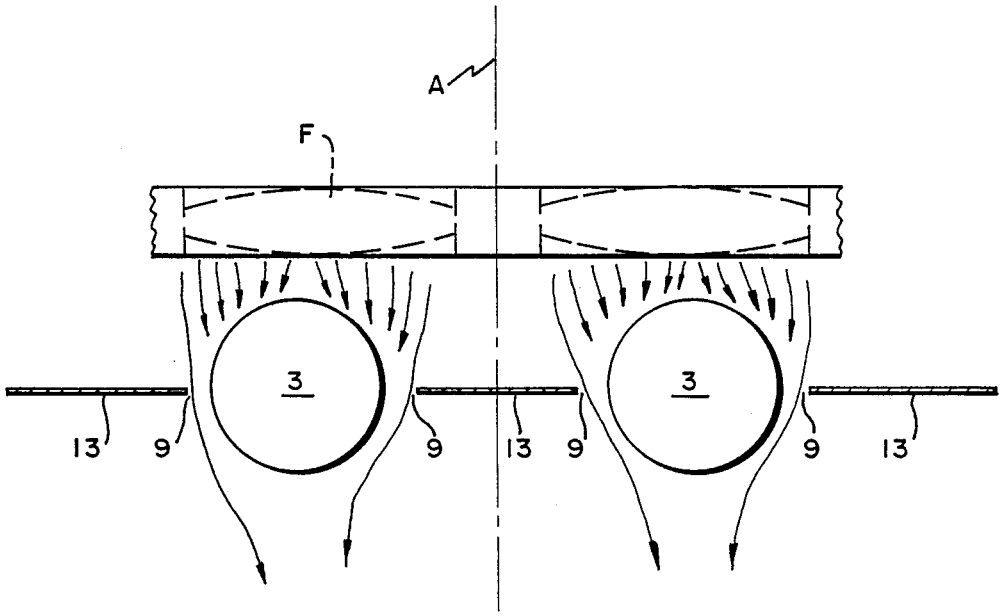
FIG. 3

AIR SHROUD FOR CYLINDER AND CYLINDER HEAD ASSEMBLIES

BACKGROUND OF THE INVENTION

1. Field of the Invention

The present invention relates to the cooling of the cylinder and cylinder head assemblies of air-cooled engines and compressors. In particular, the invention is directed to a shroud for increasing the efficiency of the cooling airflow from a fan to the assemblies of cylinders and cylinder heads.

2. Description of Related Art

In U.S. Pat. No. 2,150,912 to Clapp, an arrangement for improving the cooling effect of air displaced by a cooling fan of an air compressor is disclosed wherein a shrouding of the compressor is provided in the form of a shrouding box which sits over the cylinder heads and on top of the compressor block, and which has a double wall construction, the inner walls of which converge toward an outward end of the box at which an opening for the egress of air from the rear of the shrouding box is provided. In this way, only some of the air which is channeled into the shrouding box from the cooling air fan by supporting side wall plates of an enclosure for the cooling air fan passes over the fins of a first of two axially arranged cylinder heads while all of the air is forced over the fins of the downstream, second cylinder head, before being discharged through the egress opening of the shrouding box. However, such a double wall enclosure is relatively expensive to produce and the particular arrangement of Clapp is only suitable for arrangements wherein the cylinder heads are arranged in a line along the axis of the fan, as opposed to situations wherein, for example, the cylinder heads are in an array that is in a plane oriented perpendicular to the flow axis.

In U.S. Pat. No. 1,944,878, a cowling or shrouding for an annular array of cylinder heads of an air-cooled aircraft engine is disclosed. This airflow-control cowling is of a conoidal shape for increasing the flow of air that passes around and between the cylinders to cool them, and while no particular baffle arrangement is shown or described, it is taught that the effectiveness of the cowling can be increased through the use of baffles near the engine cylinders to force the airflow over the hotter parts of the cylinders. This cowling is supported by being attached to the cylinder heads of the engine by supporting struts. However, this cowling is relatively large and is particularly designed for use with aircraft engines having push and pull type propellers. It does not suggest a simple, inexpensive and efficient means for producing a comparable effect for air-cooled multicylinder engines which are supported upon the ground and thus do not have an annular array of cylinders, nor does it disclose a cowling which creates an orifice effect that avoids wasting of cooling air and increases the surface area of the cylinders over which the cooling air flows.

Examples of other arrangements for improving the guiding of cooling air over cylinder head assemblies of air-cooled multicylinder internal combustion engines are shown in U.S. Pat. Nos. 3,017,943 and 4,204,486. However, these arrangements are relatively complex and are designed to substantially enclose the entire area of the engine from around the entire periphery of the cooling fan to the area surrounding the cylinder head assembly.

Thus, there is still a need for a simple, inexpensive and efficient cowling for improving the cooling of cylinder and cylinder head assemblies of air-cooled engines, such as reciprocating air and gas compressors having an arcuate array of cylinder heads disposed about the axis of flow from a cooling air fan, that can be easily added onto existing cylinder head assemblies (as well as removed for service) without significantly increasing either the size of the overall arrangement.

SUMMARY OF THE INVENTION

It is a primary object of the present invention to provide a shroud for cylinder and cylinder head assemblies of an air-cooled engines and compressors.

It is a further object of the present invention to achieve the foregoing object in an inexpensive manner that is able to be implemented upon existing engines and compressors wherein the cylinder and cylinder head assemblies are arranged in an arcuate array extending radially outwardly relative to the axis of flow generated by a cooling fan.

In accordance with the present invention, these and other objects are achieved through the use of a sheet metal shroud that is fastened to the cylinder heads by means of standoffs screwed directly into the cylinder heads, and has an axially extending wall which wraps around the cylinder head assembly between the fan and at least the widest portion of the cylinder and cylinder head assemblies to create an airflow channel, and from which cooler fins extend radially inwardly to block the normally open area between the cylinder and cylinder head assemblies so as to create an orifice gap about the cylinder and Cylinder head assemblies through which the cooling air will be forced to pass. Due to the orifice effect created, the cooling air has its velocity increased and actually continues to wrap itself around the cylinder and cylinder head assembly after passing through the orifice gap before passing clear, in addition to causing more cooling air to pass at an increased rate for carrying away a greater amount of heat.

These and other objects, features and advantages of the present invention will become more apparent from the following detailed description when viewed in conjunction with the accompanying drawings.

BRIEF DESCRIPTION OF THE DRAWINGS

FIGS. 2 and 3 show the flow of air delivered by a cooling fan of the FIG. 1 compressor over its cylinder and cylinder head assemblies without and with the shroud of the present invention, respectively.

DETAILED DESCRIPTION OF THE PREFERRED EMBODIMENTS

Figure 1:
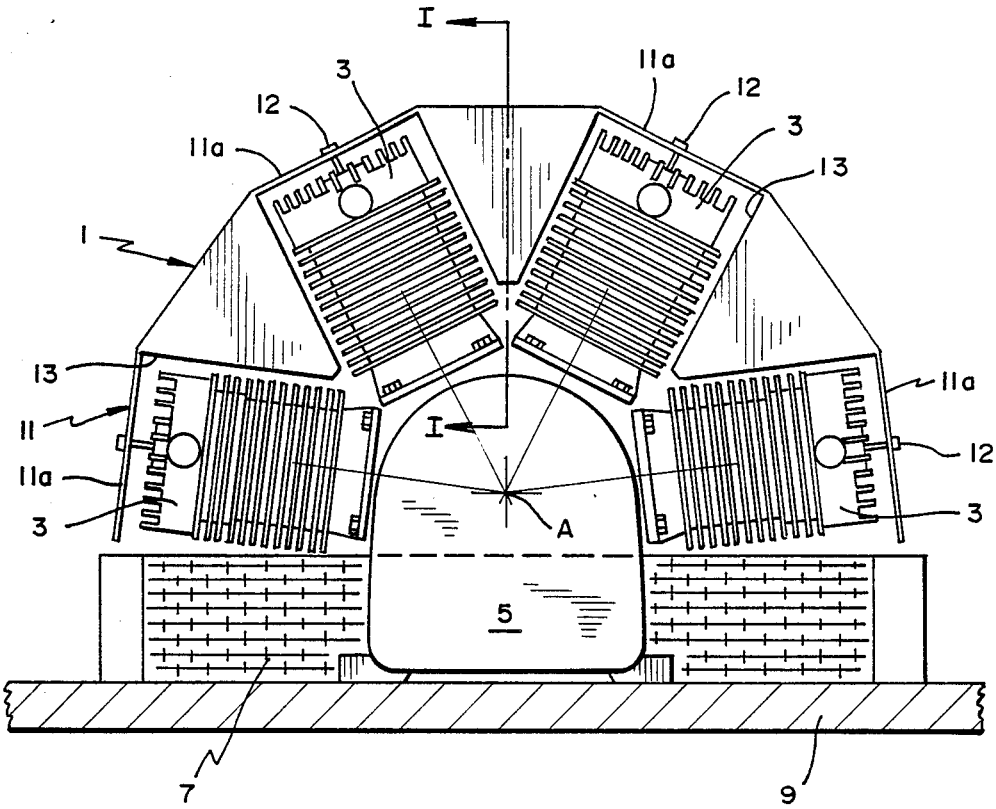
FIG. 1 illustrates a preferred embodiment in accordance with the present invention mounted upon the cylinder head assemblies of an air-cooled compressor having an aftercooler.

An air shroud, designated generally by the reference numeral 1, is shown in FIG. 1 mounted upon the cylinder and cylinder head assemblies 3 of an air-cooled reciprocating compressor 5 having an aftercooler 7, which is shown resting upon a floor, support bed, or other support surface 9. In this regard, it is noted that while an air-cooled compressor is illustrated, such is intended as being merely representative of the type of equipment to which the shroud of the present invention is applicable, and thus, could be any equivalent engine or the like having such an array of cylinder and cylinder head assemblies, i.e., wherein the cylinder and cylinder head assemblies 3 are disposed radially relative to the axis of cooling airflow from a cooling air fan F that is mounted on the end of the compressor crankshaft, this axis being designated A in FIGS. 1–3.

Figure 1A:
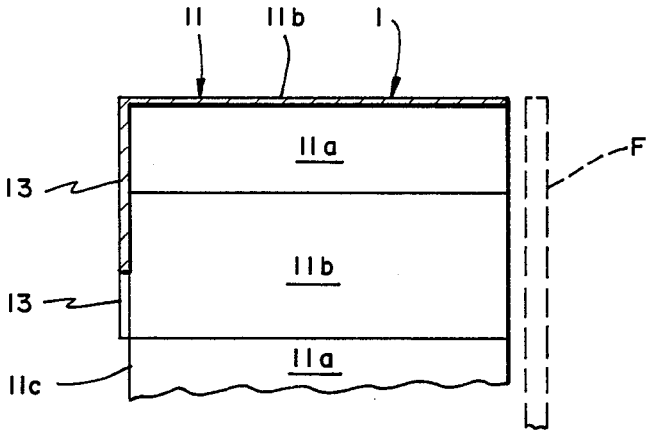
FIG. 1*a* is a partial sectional view of only the shroud shown in FIG. 1, taken alone line I—I therein.

As can be seen from FIGS. 1, 1*a*, the shroud 1 has a flow channel portion 11 which has the shape of a polygonal segment that wraps around the periphery of the cylinder and cylinder head assemblies 3 (FIG. 1), and which forms an air channel from the cooling air fan F, at a first axial edge, to at least a maximum diameter point of the cylinder and cylinder head assemblies 3, at an opposite axial edge 11*c* of the flow channel portion (see FIGS. 1*a* and 3). In this way, an axial flow of cooling air is directed from the fan F toward the cylinder and cylinder head assemblies 3, which are arranged in the airflow path and extend radially relative to the axis of flow A. Fastening means, such as standoffs 12, are screwed directly into the top of each cylinder head of assembly 3.

FIG. 2 shows the conventional situation wherein a cooling air fan F is cast as an integral part within the compressor flywheel that is mounted on the end of the compressor crankshaft, so that when the compressor flywheel is turned by a power drive or electric motor, engine, etc., the fan F in the flywheel pushes air across the cylinder head assemblies. While this conventional practice works well, a large amount of the cooling air is wasted due to the fact that the cooling air seeks the path of least resistance past the cylinder and cylinder head assemblies 3. To correct for this deficiency, fins 13 are provided which depend from the flow channel portion 11 at the axial edge 11*c* (which is opposite fan F and is, preferably, located between the axial midpoint of the cylinder and cylinder head assemblies and a point that is approximately 50 to 90% of the distance across the cylinder and cylinder head assemblies in the direction of flow thereacross. These fins 13 block the open area space S (FIG. 2) that normally exists between the cylinder and cylinder head assemblies in a manner creating an airflow orifice gap g aftercooler about the perimeter of each cylinder and cylinder head assembly 3, between the fin and the adjacent cylinder and cylinder head assemblies. Since all of the air must pass through the orifice gaps g aftercooler, more cooling air is caused to pass over the assemblies 3 at an increased rate in such a manner that the airflow continues to wrap itself around the assemblies 3 after passing through the orifice gaps g, before passing clear. Accordingly, more of the heat generated within the cylinders and accumulated in the cylinder and cylinder head assemblies is carried away so that lower operating temperatures are achieved, which leads to increased valve and piston ring life and associated decreases in down time and maintenance costs.

Figure 4:
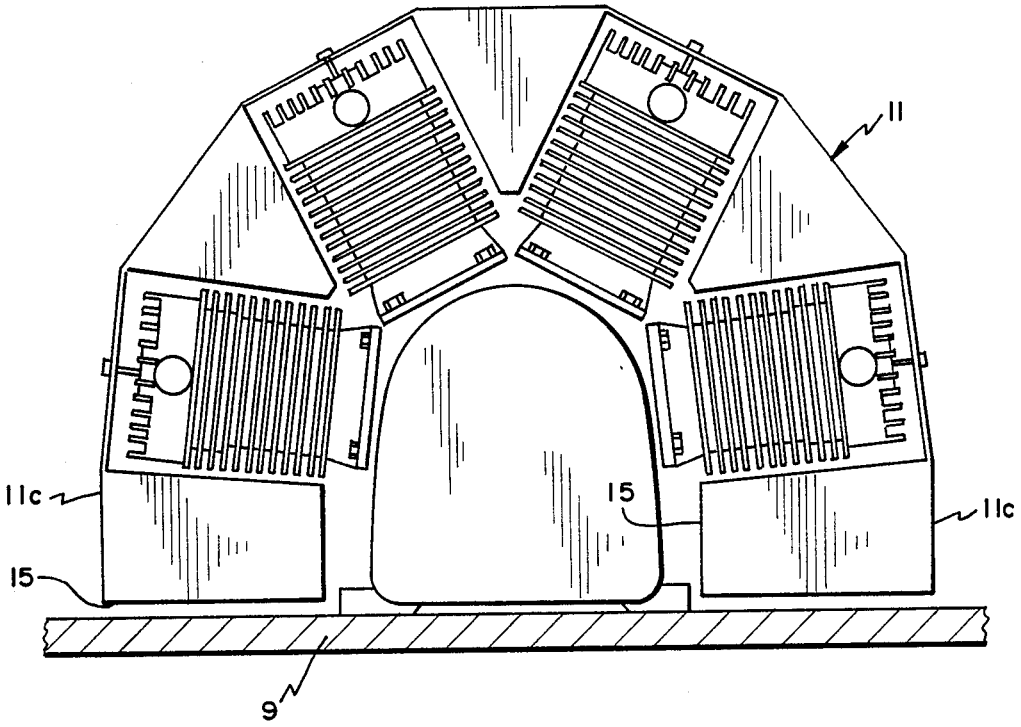
FIG. 4 illustrates a modified shroud in accordance with the present invention mounted upon a compressor of the type shown in FIG. 1, but where no aftercooler exists.

It should be appreciated that the number of sides of the polygonal segment shape of the flow channel portion 11 will be a direct function of the number of cylinder and cylinder head assemblies and whether an aftercooler 7 or other corresponding structure is present, as in FIG. 1, or absent as in FIG. 4. In the case of FIG. 1, alternate sides 11*a*, which essentially correspond in width to the width of a respective cylinder and cylinder head assembly 3, extends across the top end thereof and the fins 13 are substantially triangular, plate-shaped members having a base width matched to the width of intervening sides 11*b*, which are located between the alternate sides 11*a*. As can be appreciated from FIG. 1, by "substantially triangular", is meant that it is possible to use a frusto-triangular shape having no apex. Advantageously, the fins 13 and flow channel portion 11 are integrally formed portions of a single sheet metal member, the fins being formed as radially inwardly folded edge projections, as shown in FIG. 1*a*; although these fins 13 can be attached by welding instead. Furthermore, in the case where the area below the cylinder and cylinder head assemblies 3 is not blocked by an aftercooler 7 or other structure, as shown in FIG. 4, an additional side can be added at each end of the polygonal segment-shaped flow channel portion 11 with bottom fins 15 being provided extending inwardly therefrom as a means for blocking the open area between the array of cylinder and cylinder head assemblies 3 and support 9.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Air shroud for cylinder and cylinder head assemblies of air-cooled compressors and engines of the type having a cooling air fan for producing an axial flow of cooling air and an array of cylinder and cylinder head assemblies arranged in the path of the axial flow and extending radially relative to the axis of said flow, said shroud comprising: a flow channel portion having a polygonal segment shape wrapping around the periphery of the array of cylinder and cylinder head assemblies and forming an air channel which extends from said cooling air fan, at a first axial edge, to a point between 50% and 90% of the distance across said cylinder head assemblies, at an opposite axial edge of the flow channel portion in an air flow direction; fastening means for attaching said flow channel portion atop each of the cylinder and cylinder head assemblies; and fins depending from said flow channel portion at said opposite axial edge; wherein each of said fins blocks an open area between adjacent cylinder and cylinder head assemblies in a manner creating an airflow orifice gap about its perimeter between the fin and the adjacent cylinder and cylinder head assemblies as a means for increasing the airflow and airflow rate of said cooling air over the cylinder and cylinder head assemblies and for creating a wrapping of said airflow around said cylinder head assemblies after said cooling air passes through said orifice gap.

2. Air shroud according to claim 1, wherein alternate sides of said polygonal segment shape essentially correspond in width to the width of a respective cylinder and cylinder head assembly and extend across a top end thereof; wherein intervening sides of said polygonal segment shape span the distance between adjacent cylinder assemblies; and wherein said fins are substantially triangular plate-shape members having a base width matched to the width of said intervening sides.

3. Air shroud according to claim 2, wherein said fins and flow channel portion are integrally formed portions of a single sheet metal member, said fins being formed as radially inwardly folded edge projections.

4. Air shroud according to claim 3, wherein bottom fins are provided at each end of said segment shape, each said bottom fin forming a means for blocking an open area below a cylinder and cylinder head assembly at a respective end of said array of cylinder and cylinder head assemblies.

5. Air shroud according to claim 1, wherein said fins and flow channel portion are integrally formed portions of a single sheet metal member, said fins being formed as radially inwardly folded edge projections.

6. Air shroud according to claim 5, wherein said fastening means comprises standoffs screwed into the cylinder and cylinder head assemblies.

7. Air shroud according to claim 5, wherein bottom fins are provided at each end of said segment shape, each said bottom fin forming a means for blocking an open area below a cylinder and cylinder head assembly at a respective end of said array of cylinder and cylinder head assemblies.

8. Air shroud according to claim 1, wherein bottom fins are provided at each end of said segment shape, each said bottom fin forming a means for blocking an open area below a cylinder and cylinder head assembly at a respective end of said array of cylinder and cylinder head assemblies.

9. Air shroud according to claim 1, wherein said fastening means comprises standoffs screwed into the cylinder and cylinder head assemblies.

* * * * *